US007287394B2

(12) United States Patent
Taras et al.

(10) Patent No.: US 7,287,394 B2
(45) **Date of Patent: *Oct. 30, 2007**

(54) REFRIGERANT HEAT PUMP WITH REHEAT CIRCUIT

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 187 days.

This patent is subject to a terminal disclaimer.

(21) Appl. No.: 10/942,679

(22) Filed: Sep. 16, 2004

(65) Prior Publication Data

US 2006/0053821 A1 Mar. 16, 2006

(51) Int. Cl.
*F25B 29/00* (2006.01)
*F25D 17/06* (2006.01)

(52) U.S. Cl. ..... 62/159; 62/324.1; 62/324.6

(58) Field of Classification Search ..... 62/324.1, 62/324.6, 159, 196.4, 90, 92, 93
See application file for complete search history.

(56) References Cited

U.S. PATENT DOCUMENTS

| | | | | |
|---|---|---|---|---|
| 3,264,840 | A | 8/1966 | Harnish | |
| 4,876,859 | A | 10/1989 | Kitamoto | |
| 5,094,085 | A | 3/1992 | Irino | |
| 5,095,712 | A | 3/1992 | Narreau | |
| 5,157,933 | A | 10/1992 | Brendel | |
| 5,622,057 | A * | 4/1997 | Bussjager et al. | 62/173 |
| 5,875,637 | A | 3/1999 | Paetow | |
| 5,953,926 | A | 9/1999 | Dressler | |
| 6,055,818 | A | 5/2000 | Valle | |
| 6,206,652 | B1 | 3/2001 | Caillat | |
| 6,276,148 | B1 | 8/2001 | Shaw | |
| 6,381,970 | B1 | 5/2002 | Eber | |
| 6,422,308 | B1 * | 7/2002 | Okawara et al. | 165/202 |
| 6,427,461 | B1 | 8/2002 | Whinery | |
| 6,595,012 | B2 | 7/2003 | Rafalovich | |
| 6,644,049 | B2 * | 11/2003 | Alford | 62/90 |
| 6,701,723 | B1 | 3/2004 | Dobmeier | |
| 6,705,093 | B1 * | 3/2004 | Taras et al. | 62/90 |
| 6,941,770 | B1 | 9/2005 | Taras | |
| 2003/0136140 | A1 | 7/2003 | Maeda | |
| 2006/0053820 | A1 * | 3/2006 | Taras et al. | 62/324.1 |
| 2006/0053822 | A1 * | 3/2006 | Taras et al. | 62/324.1 |
| 2006/0053823 | A1 * | 3/2006 | Taras et al. | 62/324.1 |

FOREIGN PATENT DOCUMENTS

| | | | |
|---|---|---|---|
| JP | 56051963 A | * | 5/1981 |
| JP | 08029012 A | * | 2/1996 |

* cited by examiner

*Primary Examiner*—Chen-Wen Jiang
(74) *Attorney, Agent, or Firm*—Carlson, Gaskey & Olds

(57) ABSTRACT

A refrigerant heat pump system is operable in both heating and cooling modes. A reheat circuit is integrated into the system schematic to provide improved control over temperature and humidity and to cover a wide spectrum of sensible and latent capacity demands.

18 Claims, 1 Drawing Sheet

REFRIGERANT HEAT PUMP WITH REHEAT CIRCUIT

BACKGROUND OF THE INVENTION

This invention relates to a heat pump that is operable in both a cooling and a heating mode, and wherein a reheat coil is incorporated into the circuit.

Refrigerant systems are utilized to control the temperature and humidity of air in various indoor environments to be conditioned. In a typical refrigerant system operating in the cooling mode, a refrigerant is compressed in a compressor and delivered to a condenser (or outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or indoor heat exchanger). In the evaporator heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

The above description is of a refrigerant system being utilized in a cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator and exchangers heat with a relatively cold outdoor air. Heat pumps are known as the systems that can reverse the refrigerant flow through the refrigerant cycle in order to operate in both heating and cooling modes. This is usually achieved by incorporating a four-way reversing valve or an equivalent device into the system schematic downstream of the compressor discharge port. The four-way reversing valve selectively directs the refrigerant flow through indoor or outdoor heat exchanger when the system is in the heating or cooling mode of operation respectively. Furthermore, if the expansion device cannot handle the reversed flow, than a pair of expansion devices, each along with a check valve, are to be employed instead.

In some cases, while the system is operating in the cooling mode, the temperature level, to which the air is brought to provide a comfort environment in a conditioned space, may need to be higher than the temperature that would provide the ideal humidity level. This has presented design challenges to refrigerant system designers. One way to address such challenges is to utilize various schematics incorporating reheat coils. In many cases, the reheat coils, placed on the way of indoor air stream behind the evaporator, are employed for the purpose of reheating the air supplied to the conditioned space after it has been cooled in the evaporator, and where the moisture has been removed.

While reheat coils have been incorporated into the air conditioning systems operating in the cooling mode, they have not been incorporated into heat pumps that are operable in both cooling and heating modes. Thus, a reheat coil would provide an enhanced control over temperature and humidity in heat pump applications as well.

SUMMARY OF THE INVENTION

In a disclosed embodiment of this invention, a refrigerant heat pump system is operable in either a cooling or a heating mode by reversing the flow of refrigerant from the compressor through the circuit by utilizing a main flow control device such as a four-way reversing valve. A reheat coil is incorporated into the circuit, and is selectively operated in the cooling mode to receive a flow of a relatively hot refrigerant, and reheat an airflow (by means of heat transfer interaction with this refrigerant) to a higher temperature than would otherwise be provided by the conventional design schematic. In general, the reheat coil allows for the dehumidified air to be supplied to an environment to be conditioned at the desired temperature. A stream of air is passed over an indoor heat exchanger, which will maintain the air at a low temperature, assuring enough moisture to be removed from the air, but at the same time at a temperature lower than desired in the conditioned environment. At least a portion of this air is then passed over the reheat coil, where it is reheated to the target temperature.

While preferred schematics are disclosed, design variations would come within the scope of this invention.

The following specification and drawings are not intended to cover a wide variety of the known reheat circuit designs and only show exemplary circuit schematics to convey the benefits obtained from the teachings of this invention.

DETAILED DESCRIPTION OF THE PREFERRED EMBODIMENT

Figure 1:
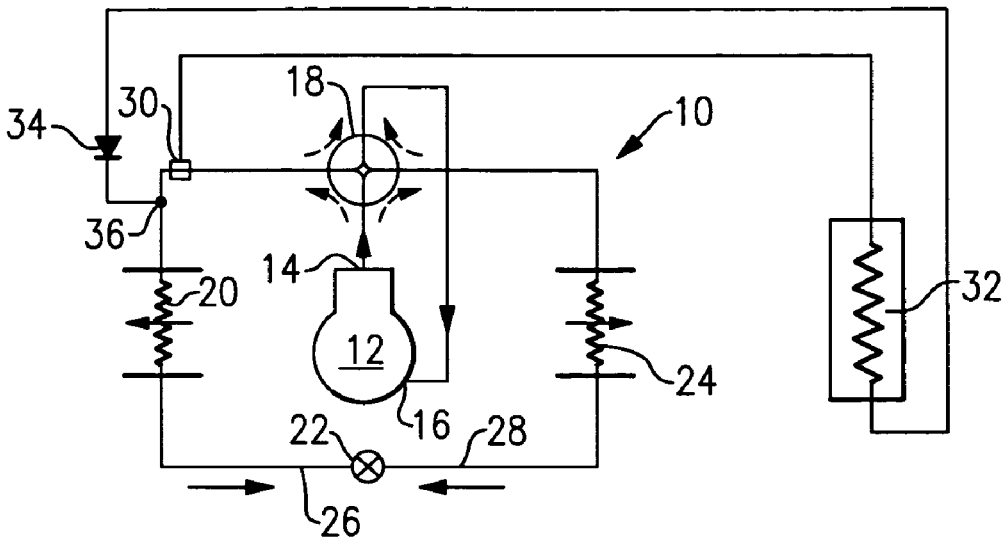
FIG. 1 shows a first schematic.

FIG. 1 shows a heat pump system 10 incorporating a compressor 12 delivering compressed refrigerant to a discharge line 14, and receiving a refrigerant to be compressed from a suction line 16. A main flow control device such as a four-way reversing valve 18 routes the refrigerant to either an outdoor heat exchanger or an indoor heat exchanger, as shown, in a cooling or heating mode of operation respectively. In the cooling mode, the refrigerant passes from the discharge line 14 through the four-way reversing valve 18, and downstream to an outdoor heat exchanger 20. Downstream of the outdoor heat exchanger 20 is an expansion device 22, and downstream of the expansion device 22 is an indoor heat exchanger 24. The refrigerant is returned back to the compressor 12 again through the four-way reversing valve 18 and through the suction line 16. In the conventional cooling mode of operation, the air flowing over indoor heat exchanger 24 (an evaporator in this case) is cooled and usually dehumidified before it is supplied to the environment to be conditioned.

In the heating mode, the refrigerant passes from the discharge line 14, through the four-way valve 18, to the indoor heat exchanger 24, the expansion device 22, the outdoor heat exchanger 20, once again to the four-way valve 18, to the suction line 16, and finally back to the compressor 12. In the heating mode, the air flowing over the indoor coil 24 (a condenser in this case) is heated before entering the conditioned space.

As known in the art, in case the expansion device 22 cannot handle the reversed flow, it has to be substituted by two assemblies, each containing a unidirectional expansion device and a check valve for control of refrigerant flow in the appropriate direction.

As shown in FIG. 1, the refrigerant flow line 26 incorporates a three-way valve 30 that selectively allows refrigerant to be tapped off of the main refrigerant flow in line 26 to a reheat coil 32. Refrigerant flows through the reheat coil 32, through a check valve 34, and returns to a point 36 to the main refrigerant circuit. As known in the art, a three-way valve can be substituted by a pair of ON/OFF valves.

The reheat coil is positioned to be in the path of air passing over the indoor heat exchanger 24. The reheat coil is utilized in the cooling mode of operation when a system control determines it would be desirable to predominantly have dehumidification of the air being supplied to an environment to be conditioned, while maintaining the temperature level. The system control manages the refrigerant flow and system operation such that the indoor heat exchanger 24 conditions the airflow heading to the indoor environment to be cooled and dehumidified with at least a portion of that air then being passed over the reheat coil, which reheats the air to the desired temperature for the environment. Thus, by utilizing reheat coil 32 in the cooling mode, the present invention provides better control over the operation of a heat pump in terms of temperature and humidity, enhancing its operational flexibility and establishing a broader coverage of the external latent and sensible load demands. Although a hot gas reheat schematic is shown in FIG. 1, the teachings of the invention are not related to any particular reheat system design and are transparent to any reheat concept.

Figure 2:
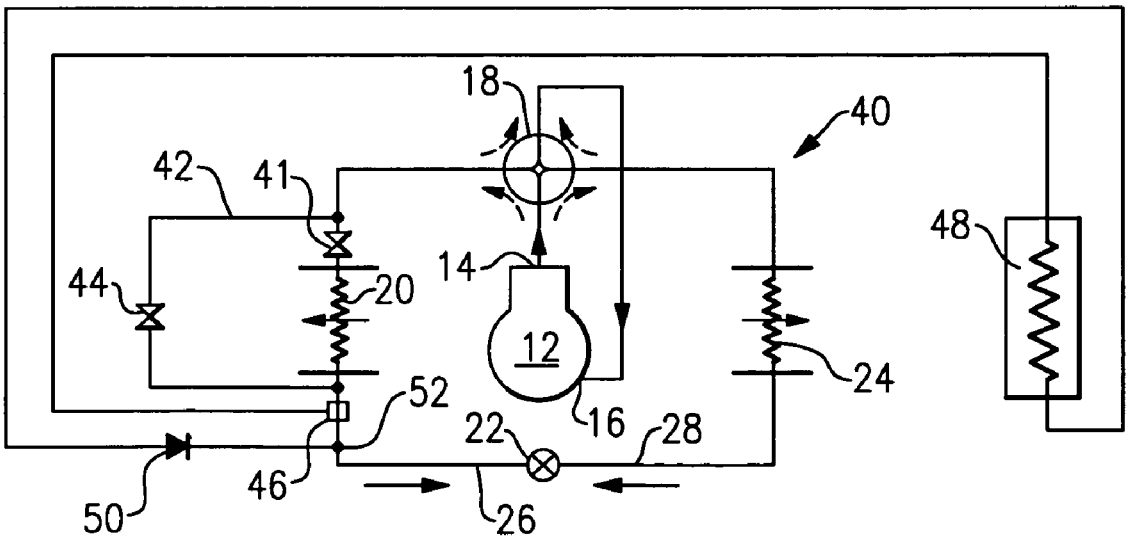
FIG. 2 shows a second schematic.

FIG. 2 shows another embodiment wherein the three-way valve 46 is positioned to be downstream of the outdoor heat exchanger 20. Again, when the reheat loop is active, the refrigerant from the three-way valve 46 passes through the reheat coil 48, a check valve 50 and is returned at a point 52 to the main refrigerant circuit.

The embodiment 40 illustrated in FIG. 2 has an additional bypass line 42 with a flow control device such as a valve 44, and another flow control device such as valve 41 for selectively bypassing the entire refrigerant flow, or a portion of a refrigerant flow, around the outdoor heat exchanger 20. Thus, system 40 can operate in four distinct modes as an air conditioner by properly directing refrigerant flowing through the system. When the entire refrigerant flow is passed through the outdoor heat exchanger 20 and the reheat coil 48 is inactive, the system operates in the conventional cooling mode. Furthermore, when the outdoor heat exchanger 20 is predominantly bypassed by the refrigerant flow and the reheat coil 48 is active, then as known, heating and dehumidification are provided to the air supplied to the conditioned space. Additionally, when the refrigerant flow is split into two paths with one portion bypassing the outdoor heat exchanger 20 flowing through the bypass line 42 and another portion passing through the outdoor heat exchanger 20, and the reheat coil 48 is active as well, predominantly dehumidification is provided to satisfy the latent load demand in the indoor environment. Lastly, when the refrigerant is predominantly passing through the outdoor heat exchanger 20 and the reheat coil 48 is active, cooling and enhanced dehumidification are provided to the occupant of the environment. Thus, operating as an air conditioner in four distinct modes, the heat pump system can provide an enhanced control over temperature and humidity for the airflow supplied to the conditioned space. Such flexibility allows for coverage of a wide spectrum of latent and sensible capacity demands by a single heat pump system design.

It has to be understood that all flow control devices can be either of the conventional shutoff or regulating type, with the latter option infinitely increasing system flexibility. Furthermore, a single three-way valve can replace a pair of the conventional valves 41 and 44 to perform identical bypass functionality of obtaining a variable sensible heat ratio. A worker ordinarily skilled in the art can design an appropriate control.

While particular schematics for the reheat circuits are disclosed, it is well understood by a person ordinarily skilled in the art that many other reheat circuit designs could be utilized and will provide the full benefits obtained from the teachings of the invention. Thus, the present invention broadly extends to the integration of a reheat circuit into a heat pump system that is operable in both heating and cooling modes and provides advantages of control flexibility over temperature and humidity in order to satisfy sensible and latent load demands.

Although preferred embodiments of this invention has been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a compressor, said compressor compressing refrigerant and delivering the refrigerant to a discharge line, said compressor receiving a refrigerant from a suction line;

an indoor heat exchanger and an outdoor heat exchanger, a main flow control device being operable to send refrigerant from said discharge line through a refrigerant circuit, to said outdoor heat exchanger, to an expansion device and then to said indoor heat exchanger when in a cooling mode, and operable to pass refrigerant through the refrigerant circuit from said discharge line to said indoor heat exchanger, to an expansion device and then to said outdoor heat exchanger when in a heating mode;

a reheat coil, said reheat coil being in communication with the refrigerant circuit to tap refrigerant through a reheat coil, and return said refrigerant to said refrigerant circuit, and an air moving device for passing air to an environment to be conditioned over said indoor heat exchanger, and passing at least a portion of said air over said reheat coil, and a bypass allowing selective bypassing of refrigerant around said outdoor heat exchanger.

2. The refrigerant system as set forth in claim 1, wherein a control for said refrigerant system selectively operates a reheat circuit flow control device to communicate at least a portion of refrigerant to said reheat coil when desired, said reheat circuit flow control device being selectively operated when dehumidification of air to be delivered into said environment to be conditioned is desired.

3. The refrigerant system as set forth in claim 2, wherein said reheat circuit flow control device is a three-way valve that selectively communicates refrigerant from said refrigerant circuit to said reheat coil, and returns said refrigerant from said reheat coil to said refrigerant circuit through a check valve.

4. The refrigerant system as set forth in claim 2, wherein said reheat circuit flow control device is positioned intermediate to said main flow control device and said outdoor heat exchanger.

5. The refrigerant system as set forth in claim 4, wherein said refrigerant from said reheat coil is returned to said refrigerant circuit between said reheat circuit flow control device and said outdoor heat exchanger.

6. The refrigerant system as set forth in claim 2, wherein said reheat circuit flow control device is positioned between said outdoor heat exchanger and said indoor heat exchanger.

7. The refrigerant system as set forth in claim 6, wherein said return line is positioned to be intermediate to said reheat circuit flow control device and said indoor heat exchanger.

8. The refrigerant system as set forth in claim 1, wherein said bypass line includes a selectively controllable valve.

9. The refrigerant system as set forth in claim 8, wherein a refrigerant line leading to said outdoor heat exchanger includes a selectively controllable valve.

10. The refrigerant system as set forth in claim 8, wherein said selectively controllable valve on the bypass around said outdoor heat exchanger is selectively opened when less cooling of the air to be delivered into an environment to be conditioned is desired.

11. The refrigerant system as set forth in claim 10, wherein said bypass around said outdoor heat exchanger is opened when heating of the air to be delivered into the environment to be conditioned is desired.

12. The refrigerant system as set forth in claim 1, wherein said system includes a single expansion device utilized in both cooling and heating modes of operation.

13. The refrigerant system as set forth in claim 1, wherein said system includes separate expansion devices for cooling and heating modes of operation.

14. The refrigerant system as set forth in claim 1, wherein air passing over said indoor heat exchanger is delivered into a building to condition the air flow in the building.

15. A method of operating a refrigerant system comprising the steps of:

(1) providing a main flow control device for selectively routing refrigerant through the system for operation in either a cooling or heating mode, through a reheat coil, and through an indoor heat exchanger positioned to be adjacent said reheat coil, such that at least a portion of air passing over said indoor heat exchanger also passes over said reheat coil;

(2) selectively operating said refrigerant system in one of said heating and cooling modes, and selectively routing refrigerant through said reheat coil when desired, said refrigerant being selectively routed through said reheat coil when dehumidification of air to be delivered into an environment to be conditioned is desired; and (3) providing a bypass around said outdoor heat exchanger, and selectively opening said bypass when desired.

16. The method of claim 15, wherein said bypass around said outdoor heat exchanger is selectively opened when less cooling of the air to be delivered into an environment to be conditioned is desired.

17. The method of claim 16, wherein said bypass around said outdoor heat exchanger is opened when heating of the air to be delivered into the environment to be conditioned is desired.

18. The method of claim 15, wherein air passing over said indoor heat exchanger is delivered into a building to condition the air flow in the building.

* * * * *